US007415413B2

(12) United States Patent
Eide et al.

(10) Patent No.: US 7,415,413 B2
(45) Date of Patent: Aug. 19, 2008

(54) METHODS FOR CONVEYING SYNTHETIC SPEECH STYLE FROM A TEXT-TO-SPEECH SYSTEM

(75) Inventors: Ellen Marie Eide, Tarrytown, NY (US); Wael Mohamed Hamza, Yorktown Heights, NY (US)

(73) Assignee: International Business Machines Corporation, Armonk, NY (US)

( * ) Notice: Subject to any disclaimer, the term of this patent is extended or adjusted under 35 U.S.C. 154(b) by 617 days.

(21) Appl. No.: 11/092,008

(22) Filed: Mar. 29, 2005

(65) Prior Publication Data

US 2006/0229872 A1 Oct. 12, 2006

(51) Int. Cl.
*G10L 13/00* (2006.01)

(52) U.S. Cl. ..... 704/260; 704/270; 704/275; 704/251; 379/88.03

(58) Field of Classification Search ..... 704/260, 704/270, 275, 251; 379/88.03
See application file for complete search history.

(56) References Cited

U.S. PATENT DOCUMENTS

| | | | | |
|---|---|---|---|---|
| 5,745,877 | A * | 4/1998 | Nijmam et al. | 704/270 |
| 2003/0028380 | A1 * | 2/2003 | Freeland et al. | 704/260 |
| 2005/0234727 | A1 * | 10/2005 | Chiu | 704/270.1 |
| 2006/0080107 | A1 * | 4/2006 | Hill et al. | 704/275 |

* cited by examiner

*Primary Examiner*—Daniel D Abebe
(74) *Attorney, Agent, or Firm*—Anne V. Dougherty; Ryan, Mason & Lewis, LLP

(57) ABSTRACT

A technique for producing speech output in a text-to-speech system is provided. A message is created for communication to a user in a natural language generator of the text-to-speech system. The message is annotated in the natural language generator with a synthetic speech output style. The message is conveyed to the user through a speech synthesis system in communication with the natural language generator, wherein the message is conveyed in accordance with the synthetic speech output style.

10 Claims, 2 Drawing Sheets

METHODS FOR CONVEYING SYNTHETIC SPEECH STYLE FROM A TEXT-TO-SPEECH SYSTEM

CROSS REFERENCE TO RELATED APPLICATIONS

This application is related to the U.S. patent application Ser. No. 11/902,057, entitled "Methods and Apparatus for Adapting Output Speech in Accordance with Context of Communication," which is filed concurrently herewith and incorporated by reference herein.

FIELD OF THE INVENTION

The present invention relates to text-to-speech systems and, more specifically, to methods and apparatus for implicitly conveying the synthetic origin of speech from a text-to-speech system.

BACKGROUND OF THE INVENTION

In telephony applications, text-to-speech (TTS) systems may be utilized in the production of speech output as part of an automatic dialog system. Typically during a call session, TTS systems first transcribe the words communicated by a caller through a speech recognition engine. A natural language understanding (NLU) unit in communication with the speech recognition engine is used to uncover the meanings behind the caller's words. These meanings may then be interpreted to determine the caller's requested information. This requested information may be retrieved from a database by a dialog manager. The retrieved information is passed to a natural language generation (NLG) block which forms a message for responding to the caller. The message is then spoken by a speech synthesis system to the caller.

A TTS system may be utilized in many current real world applications as a part of an automatic dialog system. For example, a caller to an air travel system may communicate with a TTS system to receive air travel information, such as reservations, confirmations, schedules, etc., in the form of TTS generated speech. To date, the quality of TTS systems has been at such a level that it has been clear to the caller that communication was taking place with an automated system or machine. As TTS systems improve, however, callers may become more likely to believe that they are communicating with a human, or callers may have some doubt as to whether a response during communication came from an automated system. Therefore, due to such confusion concerns, it would be beneficial for callers to be informed about whether they are requesting and receiving information from a machine or a human operator.

Using the technology presently available in TTS systems, the only way to convey information regarding the nature of the communication is to explicitly identify the machine as such during the conversation, preferably at the beginning. For example, the TTS system may provide a message such as "welcome to the automated answering assistant," or "this is not a human." While these messages may be enough to avoid confusion in some situations, the caller may not pay attention to the message, forget about the message later in the call, or not understand a more subtle message.

SUMMARY OF THE INVENTION

The present invention provides techniques for affecting the quality of speech from a text-to-speech (TTS) system in order to implicitly convey the synthetic origin of the speech.

For example, in one aspect of the invention, a technique for producing speech output in a TTS system is provided. A message is created for communication to a user in a natural language generator of the TTS system. The message is annotated in the natural language generator with a synthetic speech output style. The message is conveyed to the user through a speech synthesis system in communication with the natural language generator, wherein the message capable of being conveyed in accordance with the synthetic speech output style.

In an additional aspect of the invention, the technique described above is performed in an automatic dialog system in response to a received communication from the user in the automatic dialog system. Further, the annotation of the message may be performed manually by a designer of the automatic dialog system through a markup language. The annotation of the message may also be performed automatically in accordance with a defined set of rules.

Advantageously, the present invention conveys a reminder to a caller that communication is taking place with an automated system or a machine. This message is more pleasant for the caller to listen to than a low-quality TTS sample, and more efficient than an additional message that explicitly restates the non-human nature of the response system.

These and other objects, features, and advantages of the present invention will become apparent from the following detailed description of illustrative embodiments thereof, which is to be read in connection with the accompanying drawings.

DETAILED DESCRIPTION OF PREFERRED EMBODIMENTS

As will be illustrated in detail below, the present invention introduces techniques for implicitly conveying the synthetic origin of speech from a text-to-speech (TTS) system and, more particularly, techniques for annotating a message sent by a TTS system that affect the quality of the message to remind the caller that communication is taking place with an automated system or a machine. The synthetic nature of the speech may be implicitly conveyed to the caller in accordance with an embodiment of the present invention by selectively introducing unnatural effects into the output speech.

Figure 1:
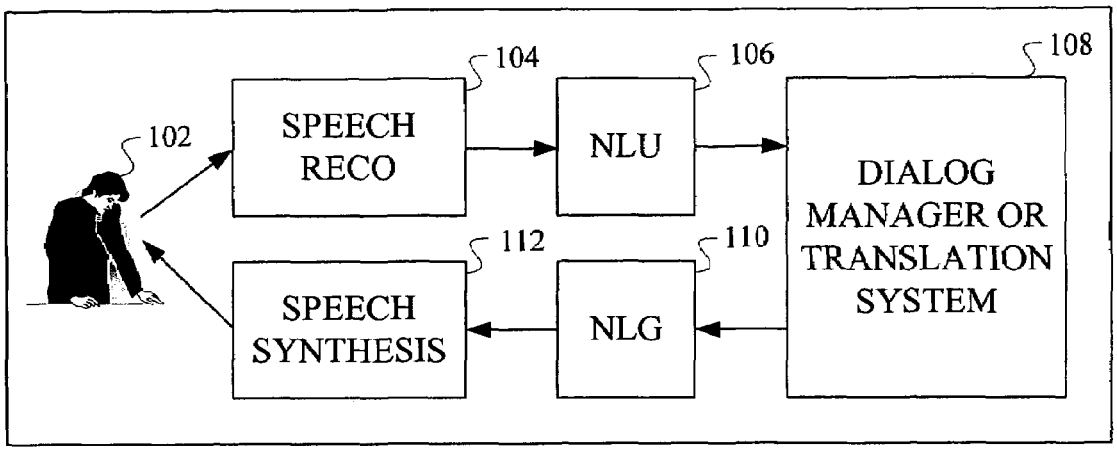
FIG. 1 is a detailed block diagram illustrating a text-to-speech system utilized in an automatic dialog system, according to an embodiment of the present invention.

Referring initially to FIG. 1, a detailed block diagram illustrates a TTS system utilized in an automatic dialog system, according to an embodiment of the present invention. A caller 102 initiates communication with the automatic dialog system, through a spoken message, typically a request for specific information. A speech recognition engine 104 receives the sounds sent by caller 102 and associates them with words, thereby recognizing the speech of caller 102. The words are sent from speech recognition engine 104 to a natural language understanding (NLU) unit 106, which determines the meanings behind the words of caller 102. These meanings are used to determine what information is desired by caller 102. A dialog manager 108 in communication with NLU unit 106 retrieves the information requested by caller 102 from a database. Dialog manager 106 may also be implemented as a translation system in another embodiment of the present invention.

The retrieved information is sent from dialog manager 108 to a natural language generation (NLG) block 110, which forms a message in response to the communication from caller 102. This message includes the requested information retrieved from the database. Once the message is formed in accordance with the embodiment of the present invention, a speech synthesis system 112 plays or outputs the message to the caller, with the requested information and the synthetic speech output style. The combination of NLG block 110 and speech synthesis system 112 makes up the TTS system of the automatic dialog system. The implicit conveyance that the message is from an artificial source through the introduction of a synthetic speech output style is implemented in the TTS system of the automatic dialog system.

The output speech with the synthetic speech output style implicitly conveys to the user the synthetic origin of the message. For example, the message "welcome to the voice-activated message center" may be spoken such that "welcome" and "center" are spoken unnaturally slowly, while "to the" is spoken slightly fast, and "voice-activated message" is spoken very rapidly. Other examples of such effects include, but are not limited to, an occasionally monotone pitch contour, a creaky voice, a buzzy voice, and a vocoder effect, which sounds as if the speaker is speaking into a long tube. Further, it is not necessary for the present invention to be implemented only in response to communication from a caller; the output speech may be produced in any situation in which information is desired to be communicated to a user. Additional embodiments of the present invention may include different automatic dialog system and TTS system components and configurations. The invention may be implemented in any system in which it is desirable to implicitly convey the automated origin of the speech through the style of the speech.

Figure 2:
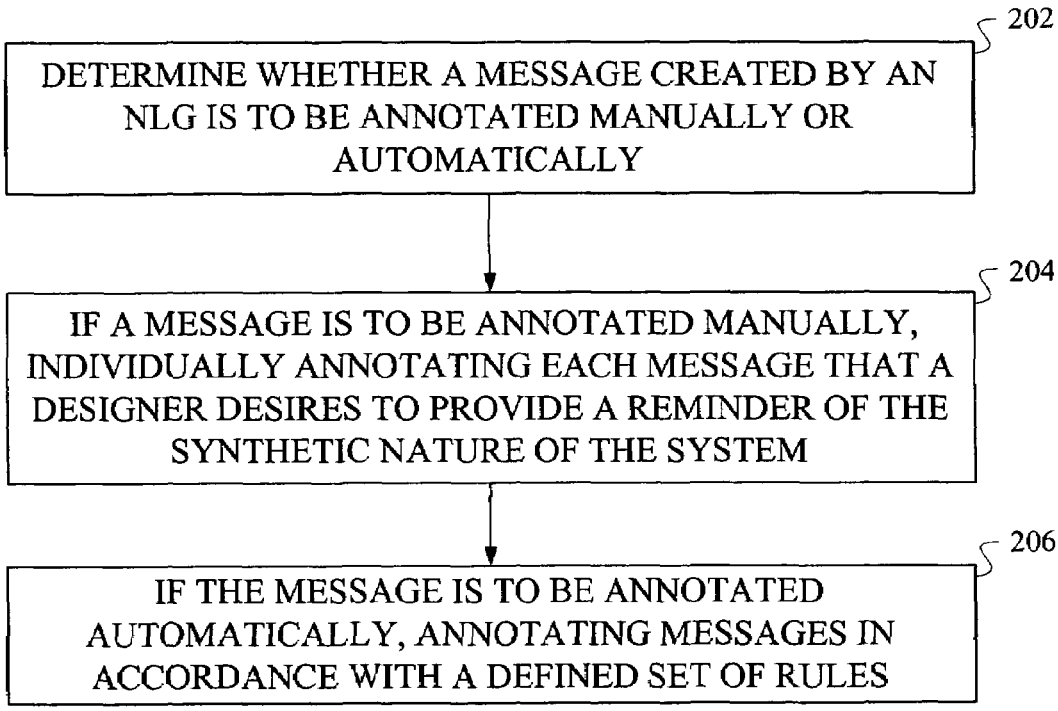
FIG. 2 is a flow diagram illustrating a message annotation methodology that conveys the synthetic nature of the text-to-speech system, according to an embodiment of the present invention.

Referring now to FIG. 2, a flow diagram illustrates a message annotation methodology that conveys the synthetic nature of the TTS system, according to an embodiment of the present invention. This may be considered a detailed description of NLG block 110 and speech synthesis system 112 in FIG. 1. In block 202, it is determined whether a message created by the NLG of the automatic dialog system is annotated manually or automatically with a synthetic speech output style. If the message is annotated manually, in block 204, a designer of the dialog application annotates each message desired to provide a reminder to a caller that communication is taking place with an automated system or a machine.

In a preferred embodiment, using a markup language, the designer of the dialog application annotates each "reminder" message generated by the NLG with the required style of artificial production. Examples include the XML document portions shown below:

. . . <prosody style="artificial" type="mono-tone"> No problem </prosody> Now, when would you like to return to New York? . . . or, . . . <prosody style="artificial" type="variable-speed"> Now, let's discuss payment. </prosody> How would you like to pay for your tickets? . . .

Speech synthesis systems of TTS engines will respond to the markup by producing the requested style of synthetic speech output. The number of the "reminder" messages and the nature of the introduced artifacts are in the hands of the application developers and are highly dependent on the nature of the application.

If the message is annotated automatically, in block 206, the message is annotated in accordance with a defined set of rules that instruct as to when and where to provide a reminder of the synthetic nature of the system during communication with the caller. This built-in mechanism decides which sentences should contain a synthetic speech output style and what those synthetic speech output styles should be. A simple example of such a rule would be "on the first sentence and every 10 sentences thereafter, vary the speed on the central word of the utterance." Alternatively, the system could randomly assign certain sentences to contain a synthetic speech output style, and randomly choose which synthetic speech output style to include.

Figure 3:
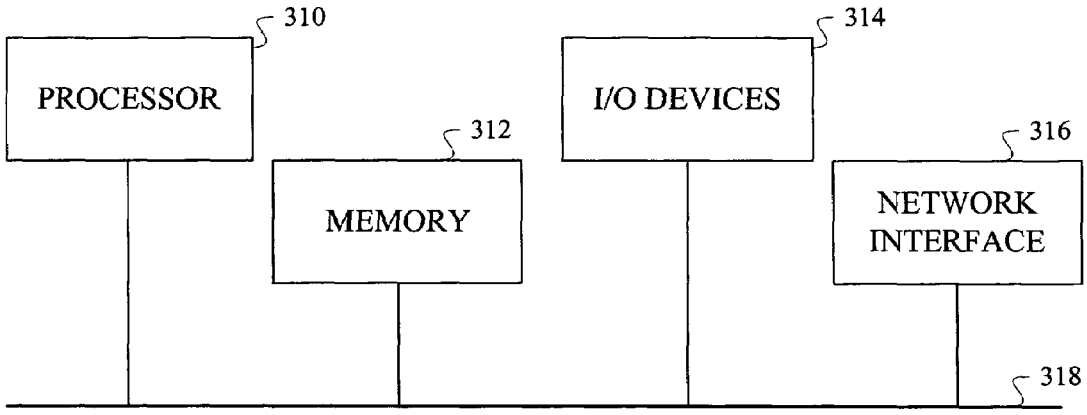
FIG. 3 is a block diagram illustrating a hardware implementation of a computing system in accordance with which one or more components/methodologies of the invention may be implemented, according to an embodiment of the present invention.

Referring now to FIG. 3, a block diagram illustrates an illustrative hardware implementation of a computing system in accordance with which one or more components/methodologies of the invention (e.g., components/methodologies described in the context of FIGS. 1 and 2) may be implemented, according to an embodiment of the present invention. For instance, such a computing system in FIG. 3 may implement the TTS system and the executing program of FIGS. 1 and 2.

As shown, the computer system may be implemented in accordance with a processor 310, a memory 312, I/O devices 314, and a network interface 316, coupled via a computer bus 318 or alternate connection arrangement.

It is to be appreciated that the term "processor" as used herein is intended to include any processing device, such as, for example, one that includes a CPU (central processing unit) and/or other processing circuitry. It is also to be understood that the term "processor" may refer to more than one processing device and that various elements associated with a processing device may be shared by other processing devices.

The term "memory" as used herein is intended to include memory associated with a processor or CPU, such as, for example, RAM, ROM, a fixed memory device (e.g., hard drive), a removable memory device (e.g., diskette), flash memory, etc.

In addition, the phrase "input/output devices" or "I/O devices" as used herein is intended to include, for example, one or more input devices for entering speech or text into the processing unit, and/or one or more output devices for outputting speech associated with the processing unit. The user input speech and the TTS system annotated output speech may be provided in accordance with one or more of the I/O devices.

Still further, the phrase "network interface" as used herein is intended to include, for example, one or more transceivers to permit the computer system to communicate with another computer system via an appropriate communications protocol.

Software components including instructions or code for performing the methodologies described herein may be stored in one or more of the associated memory devices (e.g., ROM, fixed or removable memory) and, when ready to be utilized, loaded in part or in whole (e.g., into RAM) and executed by a CPU.

Although illustrative embodiments of the present invention have been described herein with reference to the accompanying drawings, it is to be understood that the invention is not limited to those precise embodiments, and that various other changes and modifications may be made by one skilled in the art without departing from the scope or spirit of the invention.

What is claimed is:

1. A method of producing speech output in a text-to-speech system comprising the steps of:

creating a message for communication to a user in a natural language generator of the text-to-speech system;

annotating the message in the natural language generator with a synthetic speech output style, wherein the message is annotated automatically in accordance with a defined set of rules; and conveying the message to the user through a speech synthesis system in communication with the natural language generator, wherein the message is conveyed in accordance with the synthetic speech output style.

2. The method of claim 1, wherein the text-to-speech system is utilized as part of an automatic dialog system.

3. The method of claim 2, wherein the step of creating a message is performed in response to the step of receiving communication from the user of the automatic dialog system.

4. The method of claim 3, further comprising the steps of:

transcribing words in the communication from the user in a speech recognition engine of the automatic dialog system;

determining the meaning of the words of the user through a natural language understanding unit in communication with the speech recognition engine in the automatic dialog system;

retrieving requested information in accordance with the meaning of the words, from a database in communication with the natural language understanding unit in the automatic dialog system; and sending the requested information from the database to the natural language generator.

5. The method of claim 1, wherein, in the step of annotating a message, the set of rules determine a number of messages to be annotated in a communication with a user.

6. The method of claim 1, wherein, in the step of annotating a message, the set of rules annotate a first message of a communication with a user.

7. The method of claim 1, wherein, in the step of annotating a message, the set of rules annotate every tenth message of a communication with a user.

8. A method of producing speech output in a text-to-speech system comprising the steps of:

creating a message for communication to a user in a natural language generator of the text-to-speech system;

annotating the message in the natural language generator with a synthetic speech output style, wherein the synthetic speech output style comprises at least one of a monotone voice, a pitch contoured voice, a creaky voice, a buzzy voice, a vocoder effected voice and a varied speed voice; and conveying the message to the user through a speech synthesis system in communication with the natural language generator, wherein the message is conveyed in accordance with the synthetic speech output style.

9. The method of claim 8, wherein, in the step of annotating a message, the message is annotated manually by a designer.

10. The method of claim 9, wherein, in the step of annotating a message, the message is annotated using a markup language.

* * * * *